US005840136A

United States Patent [19]

Maruki et al.

[11] Patent Number: 5,840,136

[45] Date of Patent: Nov. 24, 1998

[54] TEMPERATURE-RAISING BAINITE FORMING PROCESS

[75] Inventors: Michio Maruki; Kouji Ohbayashi, both of Anjo; Takatoshi Suzuki, Aichi-ken, all of Japan

[73] Assignee: Aisin AW Co., Ltd., Japan

[21] Appl. No.: 811,147

[22] Filed: Mar. 4, 1997

[30] Foreign Application Priority Data

Mar. 5, 1996 [JP] Japan ..... 8-078263

[51] Int. Cl.[6] ..... C21D 9/00

[52] U.S. Cl. ..... 148/664; 148/639; 148/512; 148/565

[58] Field of Search ..... 148/664, 639, 148/512, 565

[56] References Cited

U.S. PATENT DOCUMENTS 4,880,477 11/1989 Hayes et al. ..... 148/141

FOREIGN PATENT DOCUMENTS 065678 1/1982 European Pat. Off. .

872956 9/1953 Germany .

601588 10/1948 United Kingdom .

9221782 10/1992 WIPO .

9428187 8/1994 WIPO .

*Primary Examiner*—Deborah Yee

*Attorney, Agent, or Firm*—Lorusso & Loud

[57] ABSTRACT

A bainite forming process for treating a steel material reduces the time required for a complete thermal treatment as well as the cycle time for the thermal treatment device without necessitating any special means for handling the steel material. The steel material is heated to a temperature higher than the austenitic transformation point, and temporarily quenched to an intermediate point temperature higher than the martensitic transformation point. Then, the temperature of the steel material is again raised towards the range corresponding to bainitic transformation to form a bainitic structure. The reheating is discontinued before the temperature corresponding to the austenitic transformation point is reached, and the steel material is then quenched. In the heating steps, only the portion to be treated by the bainite forming process is locally irradiated with a high-density energy beam.

20 Claims, 10 Drawing Sheets

TEMPERATURE-RAISING BAINITE FORMING PROCESS

BACKGROUND OF THE INVENTION

1. Field of the Invention

The present invention relates to a bainite forming process involving heat-treating a steel material to form a bainitic structure.

2. Description of the Prior Art

It is known to transform the structure of a steel material into the bainitic structure in order to improve its extensibility, drawability, strength, and the like. Conventionally, to obtain the bainitic structure, bainitic hardening is followed by bainitic tempering, an isothermal treatment such as an austempering process, and the like.

According to the former method, that is, bainitic hardening followed by bainitic tempering, the steel material is first heated to a temperature higher than an austenitic transformation point temperature and then quenched to a temperature lower than the martensitic transformation point temperature, thereby effecting a temporary bainitic hardening. Then, the hardened steel material is again heated to within a temperature range corresponding to bainitic transformation to generate the bainitic structure.

According to the latter method, that is, the austempering process, as represented by a dotted line 39 in FIG. 1, the steel material is first heated to a temperature higher than the austenitic transformation point temperature and then quenched to a lower temperature which is higher than the martensitic transformation point temperature. Then, this last (quenched) temperature is maintained as is over a long period of time, such as one to five hours, until the S curve is crossed and the bainitic transformation area is entered.

However, the above conventional methods have the following drawbacks. In the case of the former, that is, bainitic hardening followed by bainitic tempering, two separate heating steps, that is, bainitic hardening and bainitic tempering, are required. Thus, there is a considerably long time span required for the entire thermal treatment and this results in a relatively great loss of thermal energy. Besides, it is necessary to handle the hardened material and the tempered material separately in order to prevent erroneous omission of the tempering process. Thus, the handling of the steel materials becomes complicated.

On the other hand, in the case of the latter method, that is, the austempering process, the thermal treatment is executed continuously. Therefore, in comparison with the former case, the thermal energy loss is smaller and the handling of the steel material is easier. However, the austempering process, as described above, requires a relatively long isothermal treatment to obtain the bainitic structure. Such a time-consuming thermal treatment requires a long cycle time for the thermal treatment device, thereby reducing productivity.

In consideration of such conventional problems, it is an object of the present invention to provide a thermal treatment, bainite forming process for a steel material, which process is capable of reducing the thermal treatment time and the cycle time of the thermal treatment apparatus, without need for any special means for handling the steel material.

In its broadest aspect, the present invention provides a bainite forming thermal treatment process including the steps of heating a steel material to a temperature higher than its austenitic transformation point temperature, temporarily quenching the steel material to an intermediate point temperature higher than the martensitic transformation point temperature, reheating the steel material from the intermediate point temperature towards a temperature range corresponding to bainitic transformation to form a bainitic structure, discontinuing the reheating before the austenitic transformation point temperature is reached, and again quenching the steel material.

Thus, in the present invention, the steel material is heated to a temperature higher than the austenitic transformation point temperature and is then temporarily quenched to the intermediate point temperature and subsequently reheated towards (and through) a temperature range corresponding to bainitic transformation to generate bainitic structure and to thereby attain an improvement in quality.

The steel material to be treated according to the present invention, the quality of which is improved by generating a bainitic structure, may be a carbon steel such as S50C, S23C, or S10C, an alloy steel such as SNCM, SCR, or SCM, or a tool steel such as SK, SKD, SKH, or SKS.

The aforementioned intermediate point temperature is a temperature at which the quenching is discontinued and which is immediately followed by raising the temperature of the steel material again towards a temperature corresponding to bainitic transformation, after completion of the steps of heating the material to a temperature higher than the austenitic temperature and subsequently quenching the material. The intermediate point temperature is higher than the martensitic transformation point temperature. If the intermediate point temperature is lower than the martensitic transformation point temperature, martensitic transformation will be started, thereby hindering the progress of bainitic transformation.

The bainitic transformation range is represented by what is called an S curve (TTT curve) as will be described later with reference to FIG. 1.

The aforementioned temperature reached in the second heating (reheating) step should be lower than the austenitic transformation temperature. Otherwise, the problem of resumption of austenitic transformation will be encountered. The cooling following the aforementioned heating steps may be self cooling, air cooling, or oil quenching.

The terminology "bainitic structure," as used herein, has reference to any or all of the upper bainite, lower bainite, and sorbite structures. In the present invention, all these structures are collectively referred to as "bainitic structure."

Thus, according to the bainite forming process of the present invention, the treated steel material is quenched to the intermediate point temperature after being heated to a temperature higher than the austenitic transformation point temperature, and then reheated toward a temperature range corresponding to bainitic transformation. Thus, as time passes, the S bainitic transformation area is crossed by a characteristic line, representing temperature variation, substantially perpendicularly. Accordingly, formation of the bainitic structure can be completed within a short period of time. Therefore, the entire thermal treatment time is reduced and the cycle time of the thermal treatment device is also reduced. The second heating (raising) step, which raises the temperature to a temperature range corresponding to bainitic transformation, preferably raises the temperature of the treated steel material from bainitic transformation starting range to a bainitic transformation ending range. Thus, complete bainitic transformation becomes possible, and a steel material having mainly a bainitic structure is obtained, i.e. the major portion of the product of the treatment is a bainitic structure.

Both of the heating steps, i.e. the first heating wherein the material is heated to a temperature higher than the austenitic transformation point temperature and the second heating to the temperature range for bainitic transformation, are preferably executed by locally irradiating the portion of the steel material to be treated with a high-density energy beam. Thus, both heating steps can be executed with good responsiveness. In particular, it is possible to effectively treat any desired, localized portion of the steel material in accordance with the invention to produce a bainitic structure within that localized portion. Thus, the high-density energy beam irradiation is especially advantageous when a localized portion of a steel structure requires such treatment (improvement).

The high-density energy beam may be, for example, an electron beam or a laser beam. High-density energy for high frequency heating may also be utilized, although not a beam. All such heat sources are collectively referred to herein as high-density energy beams. The electron beam is generated by applying a high voltage to an electron beam gun. The laser beam is generated by applying a high voltage to a laser oscillator. The high-density energy beam is emitted separately and locally in both of the heating steps.

Preferably, the step of raising the temperature from the intermediate point temperature to the temperature range corresponding to bainitic transformation is executed gradually or stepwise.

For gradual raising of the temperature, the intensity level in irradiating with the high-density energy beam is controlled or pulse-controlled so that the pattern of temperature change from the intermediate point temperature towards the temperature range corresponding to bainitic transformation is gradual or stepped in a manner corresponding to the pulses. For example, the temperature is first kept at a constant value and then raised, or the temperature is first raised gradually and then quickly (see FIG. 5). Furthermore, the optimum heating pattern may be set in accordance with the specific material to be used so that a desired bainitic structure can be surely obtained.

Furthermore, it is preferable that the step of quenching the material to the intermediate point temperature, from the temperature higher than the austenitic transformation point temperature, be executed gradually. In this case, too, as described above, the heating pattern of the quenching can be changed. For example, the step of quenching may be first executed quickly, and then gradually (see FIG. 6). In this way, the temperature curve for the step of quenching can be controlled such that the curve lies above the martensitic transformation point temperature (intermediate point temperature) without crossing the nose of the S curve. Smooth transition from the step of quenching to that of raising the temperature can be achieved.

The aforementioned high-density energy beam may include a heating beam for heating the portion of the steel material to be improved to a temperature higher than the austenitic transformation point temperature and a separate reheating beam for raising the temperature toward the range corresponding to bainitic transformation. The heating beam is used to heat the portion to be improved, and the reheating beam is used to continuously irradiate the portion to be treated after the portion has been quenched to the intermediate point temperature. Irradiating the portion of the steel material to be treated with the heating beam and the reheating beam in succession serves to effect the two aforementioned steps of thermal treatment in succession, i.e. heating the material to a temperature higher than the austenitic transformation point temperature and then raising the temperature up towards a range corresponding to bainitic transformation and continuing through that range. Thus, the steps of heating, quenching, and reheating can be executed with better responsiveness.

The quenching can be accomplished simply by providing a certain time interval between the irradiation with the heating beam and the irradiation with the reheating beam. During such a time interval, the heat input to the portion to be treated, by the heating beam, is rapidly transmitted to the interior of the steel material and released at the exterior, thereby quenching the steel material rapidly. The time interval is that necessary for the temperature of the treated portion of the steel material to reach the aforementioned intermediate point temperature.

Alternatively, the high-density energy beam may be emitted as a single beam from a single beam generating source and divided to irradiate a plurality of portions. In this case, the single high-density beam is divided into a plurality of beams using a deflection control device or the like. In this way, a plurality of portions of the steel material may be simultaneously irradiated with the divided high-density beam, thereby allowing use of more compact irradiation equipment.

The surface layer within the treated area may be melted when heated to the temperature higher than the austenitic transformation point temperature. In this case, if it is desired to increase the depth to which the low-carbon steel is hardened, the melted portion is austenitized in an extremely short period of time. Thus, the time required for thermal treatment is further reduced. In addition, since only the temperature of the surface layer is raised, self cooling can be employed in the step of quenching.

Preferably, the step of quenching is executed at the rate of $10^3$ °C./min. or more. A rate less than $10^3$ °C./min is problematic, because ferrite+pearlite transformation may be started. However, it is preferable to set the upper limit of the quenching rate to $10^7$ °C./min.

Furthermore, the intermediate point temperature is preferably lower than the temperature corresponding to the nose of the S curve representing the bainitic transformation range. In this case, the intermediate point temperature is set below the nose of the S curve (see FIG. 1). Thus, the bainitic structure can be obtained with certainty.

BRIEF DESCRIPTION OF THE DRAWINGS

FIGS. 2(A) and 2(B) schematically illustrate use of a high-density energy beam in the first embodiment, wherein FIG. 2(A) is a side view and FIG. 2(B) is a plan view.

DESCRIPTION OF THE PREFERRED EMBODIMENTS

The temperature-raising bainite forming process according to a first embodiment of the present invention will be described with reference to FIGS. 1 and 2.

Figure 1:
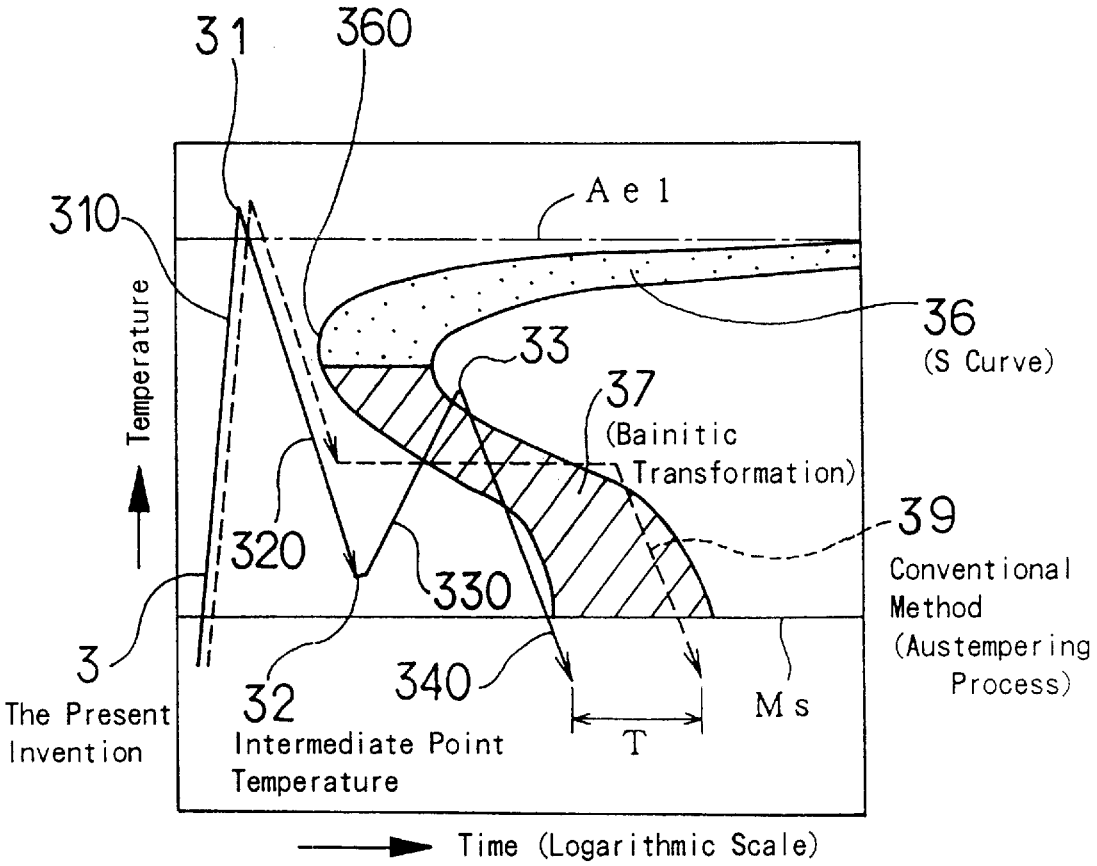
FIG. 1 is a solid-line diagram illustrating the S curve-heat pattern utilized in a first embodiment of the present invention.

As shown in FIG. 1, according to the bainite forming process of the first embodiment, a steel material 2 to be treated (FIG. 2) is first heated to a temperature 31 higher than an austenitic transformation point Ae1 (a straight line 310), and, subsequently, temporarily quenched to an intermediate point temperature 32 higher than a martensitic transformation point Ms (a straight line 340). Then, the temperature is raised again from the intermediate point temperature 32 towards and through a range 37 (straight line 330) corresponding to bainitic transformation to form bainitic structure. In other words, in the time interval between the two heating steps (during which time the quenching occurs) the temperature is not allowed to fall to the martensiic transformation point or, in other words, below the intermediate temperature. Then, the reheating step is discontinued at a temperature (33) before reaching the austenitic transformation point. Thereafter, the temperature is lowered (a straight line 340).

FIG. 1 shows an S curve 36 (TTT curve), plotted with a y-axis representing time (logarithmic scale) and a x-axis representing temperature (°C.). Shown herein are the bainite forming process according to the present invention (solid line 3) and a conventional austempering process (dotted line 39).

A time difference T (as shown in the lower right-hand region in the graph) between the temperature-raising bainite forming process 3 and the austempering process 39 represents the time saved by the present invention.

In this first embodiment, the step of reheating raises the temperature towards the aforementioned bainitic transformation range, through a temperature starting the bainitic transformation and through a temperature ending the bainitic transformation, i.e. along a straight line 330 extending diagonally upward across the area defined between the two S curves.

Figure 2A:
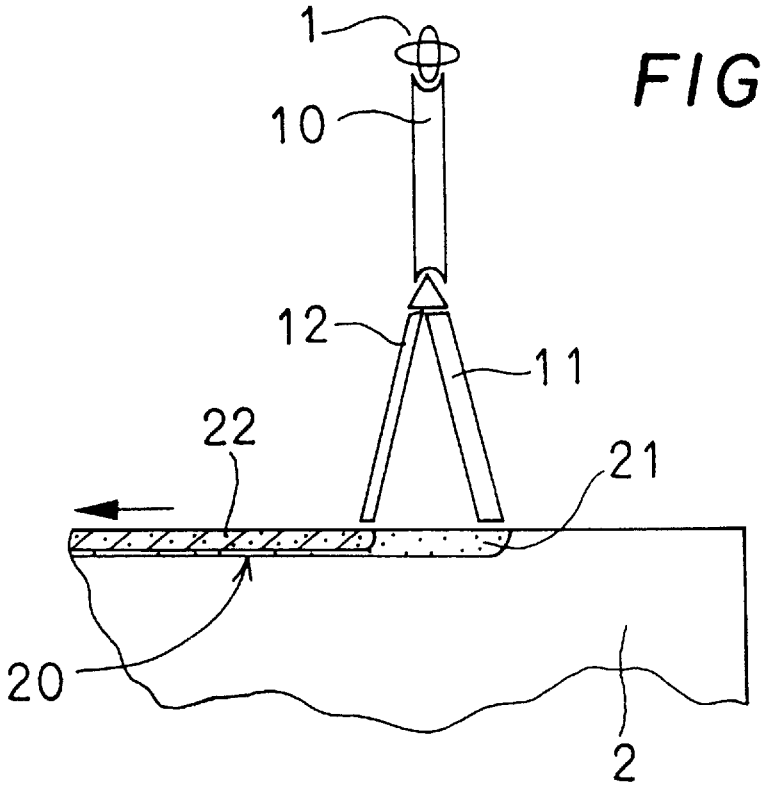
Figure 2B:
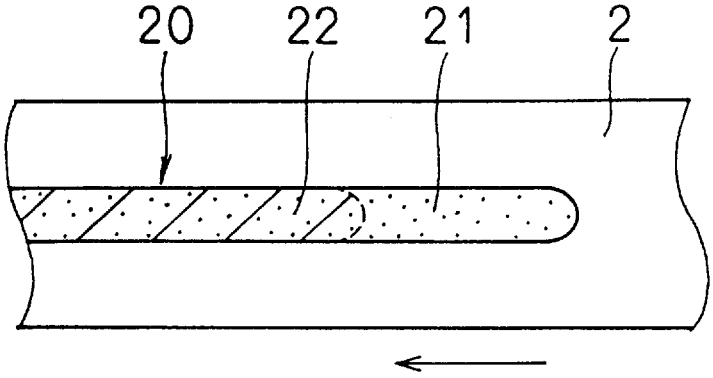

In this first embodiment, as shown in FIGS. 1 and 2, during the thermal treatment, a portion 20 of the steel material 2 to be improved is locally irradiated with high-density energy beams 11 and 12. More specifically, as illustrated in FIGS. 2(A) and 2(B), a high-density energy beam 10, emitted from a high-density energy beam generating source 1, is divided by a deflection lens into a heating beam 11 and a reheating beam 12. While the steel material 2 is moved in the direction of the arrow as shown in FIG. 2, the area 20 to be treated is first irradiated with the heating beam 11 and thereby heated to a temperature higher than the austenitic transformation point temperature.

The first irradiated portion 21 is then further irradiated with the reheating beam 12, thereby raising the temperature through the range corresponding to bainitic transformation to form a bainitic structure in the second irradiated portion 22. After the first heating by the heating beam 11, the area 20 is quickly quenched to the aforementioned intermediate point temperature, before it is again irradiated with the reheating beam 12.

As described in the foregoing, according to this embodiment, the steel is first heated to a temperature 31 higher than the austenitic transformation point temperature, is next quickly lowered to the intermediate point temperature 32 and, finally, is reheated through the range 37 corresponding to bainitic transformation.

Thus, it is possible to raise the temperature in a short period of time to the range corresponding to bainitic transformation defined by the aforementioned S curves. Accordingly, generation of the bainitic structure can be completed within a short period of time. Furthermore, since the time required for the entire thermal treatment can be reduced, the cycle time for the thermal treatment device can also be reduced.

In addition, since the thermal treatment can be executed in a single operation, no special system is required for handling the steel material.

Furthermore, according to this first embodiment, the step of raising the temperature to the range corresponding to bainitic transformation (reheating) is executed from the bainitic transformation starting range to the bainitic transformation ending range. Thus, the bainitic structure is obtained substantially over the entire treated portion 20 of the steel material 2.

In addition, according to this embodiment, the aforementioned steps of heating and reheating are executed by irradiation with a high-density energy beam(s), so that the bainitic structure is obtained only in the treated portion 20, not throughout the whole steel material 2. In other words, the steel material 2 can be locally transformed, thereby giving the desired extensibility and strength to only the treated portion.

Figure 3:
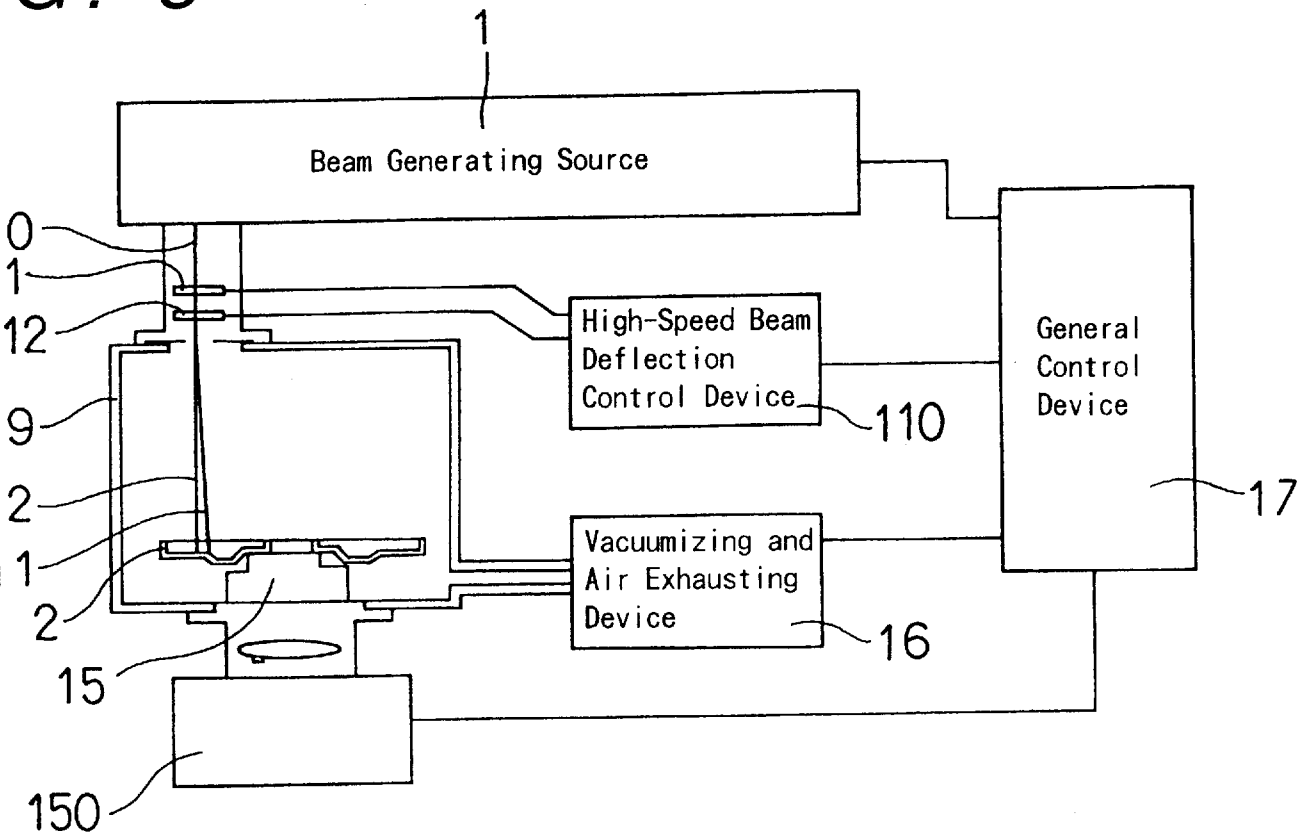
FIG. 3 is a block diagram of a thermal treatment device according to a second embodiment.
Figure 4:
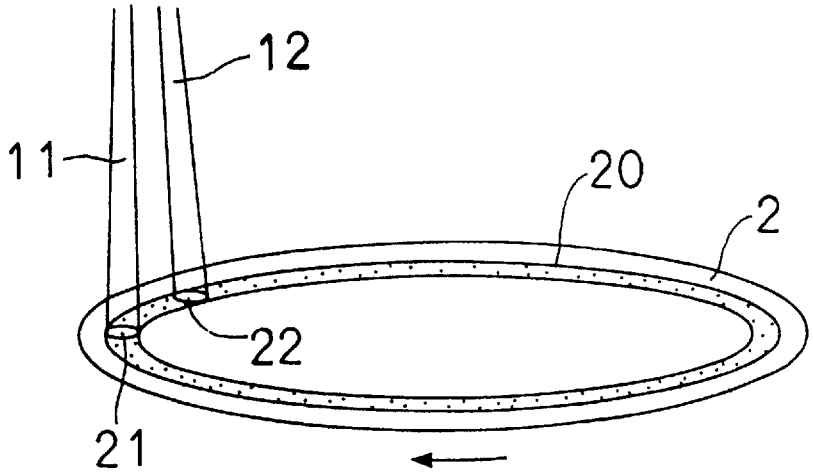
FIG. 4 is a perspective view illustrating use of high-density energy beam according to the second embodiment.

According to a second embodiment, as shown in FIGS. 3 and 4, in addition to the features of the first embodiment, the treated portion 20 (FIG. 4) of the steel material 2 is an annulus which is irradiated with the heating beam 11 and the reheating beam 12, successively, while the steel piece 2 is rotated.

The steel material 2 to be treated in this embodiment is a lock-up clutch piston used for a torque converter. The piston has a shape of a plate (see FIGS. 3 and 7) and the bainitic structure is required for an annular portion of the lock-up clutch piston (FIG. 4).

The thermal treatment device for this second embodiment is as shown in FIG. 3 and comprises a working chamber 19 for receiving the steel material 2 therein, the beam generating source 1 for radiating the heating beam 11 and reheating beam 12 into the working chamber 19, and deflection coils 111 and 112 for dividing the high-density energy beam 10 emitted from the beam generating source 1 into the heating beam 11 and beam 12. Moreover, a vacuum source 16 for reducing the internal pressure of the working chamber 19 and a high-speed deflection control device 110 for the high-density energy beam deflected by the deflection coils 111 and 112 are connected to the deflection coils and to the working chamber, respectively. The outputs of both the beams can be freely controlled by varying the frequency and waveform of the current flowing through the deflection coils 111 and 112. These devices, in turn, are controlled by a general control device 17. A motor 150 serves to rotate a mounting base 15, which supports the piece of the steel material 2 to be treated, and is disposed under the working chamber 19.

In implementing the bainite forming process using the above-described thermal treatment apparatus, the motor 150 is first actuated to cause the steel material 2 to rotate in the direction of the arrow as shown in FIG. 4. Then, the working chamber 19 is evacuated by the vacuum source 16. Then, as shown in FIGS. 3 and 4, the steel material 2 is first irradiated by the heating beam 11 and, subsequently, after a certain time interval, irradiated by the reheating beam 12. Thus, as shown in FIG. 4, the bainitic structure can be formed in an annular portion of the steel piece 2.

The effect obtained by this second embodiment is similar to that of the first embodiment.

Figure 5:
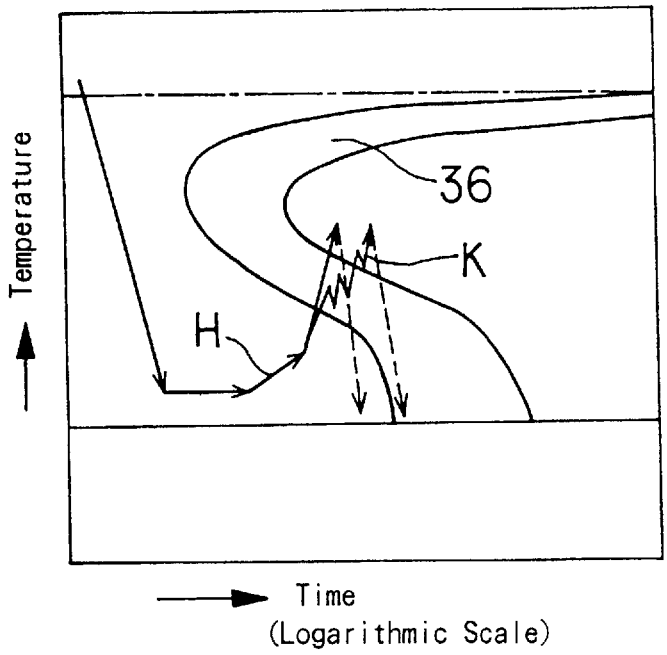
FIG. 5 is a solid-line diagram illustrating the S curve-heat pattern utilized in a third embodiment.

According to a third embodiment, as shown in FIG. 5, the step of raising the temperature from the intermediate point temperature through the range corresponding to bainitic transformation is executed gradually or stepwise. The temperature pattern H as shown in FIG. 5 illustrates an example in which the temperature is lowered to the intermediate point temperature quickly, kept constant for a short period of time, raised gradually, and then raised rapidly through the range of bainitic transformation. On the other hand, the heating pattern K in FIG. 5 shows an example in which the reheating is executed in a stepped manner. In this manner, a relatively fine bainitic structure can be obtained within a short period of time. The effect obtained by this embodiment is also similar to that of the first embodiment.

Figure 6:
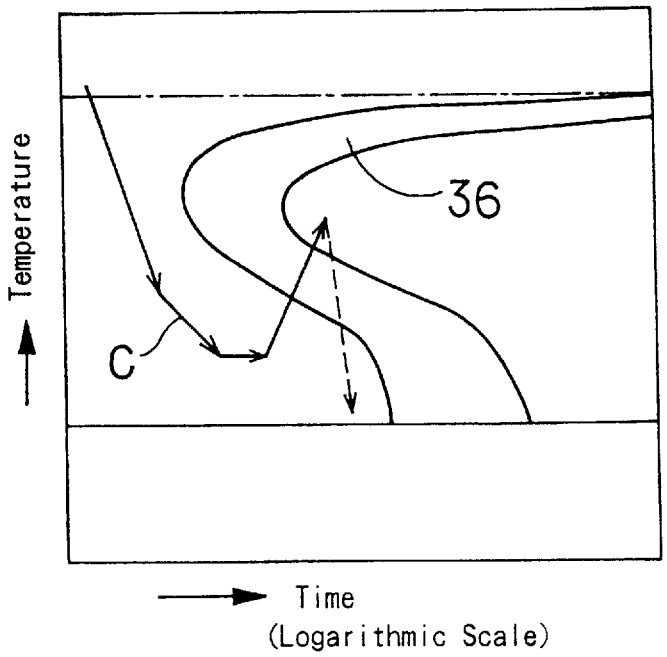
FIG. 6 is a solid-line diagram illustrating the S curve-heat pattern utilized in a fourth embodiment.

In a fourth embodiment, as shown in FIG. 6, the quenching of the steel material from the temperature higher than the austenitic transformation point to the intermediate point temperature is executed gradually. The temperature pattern C in FIG. 6 represents an example in which the temperature is lowered to the intermediate point temperature quickly and gradually, and then quickly raised through the range for bainitic transformation. Thus, a relatively fine bainitic structure can be obtained within a short period of time. The effect obtained by this embodiment is also similar to that of the first embodiment.

Figure 7:
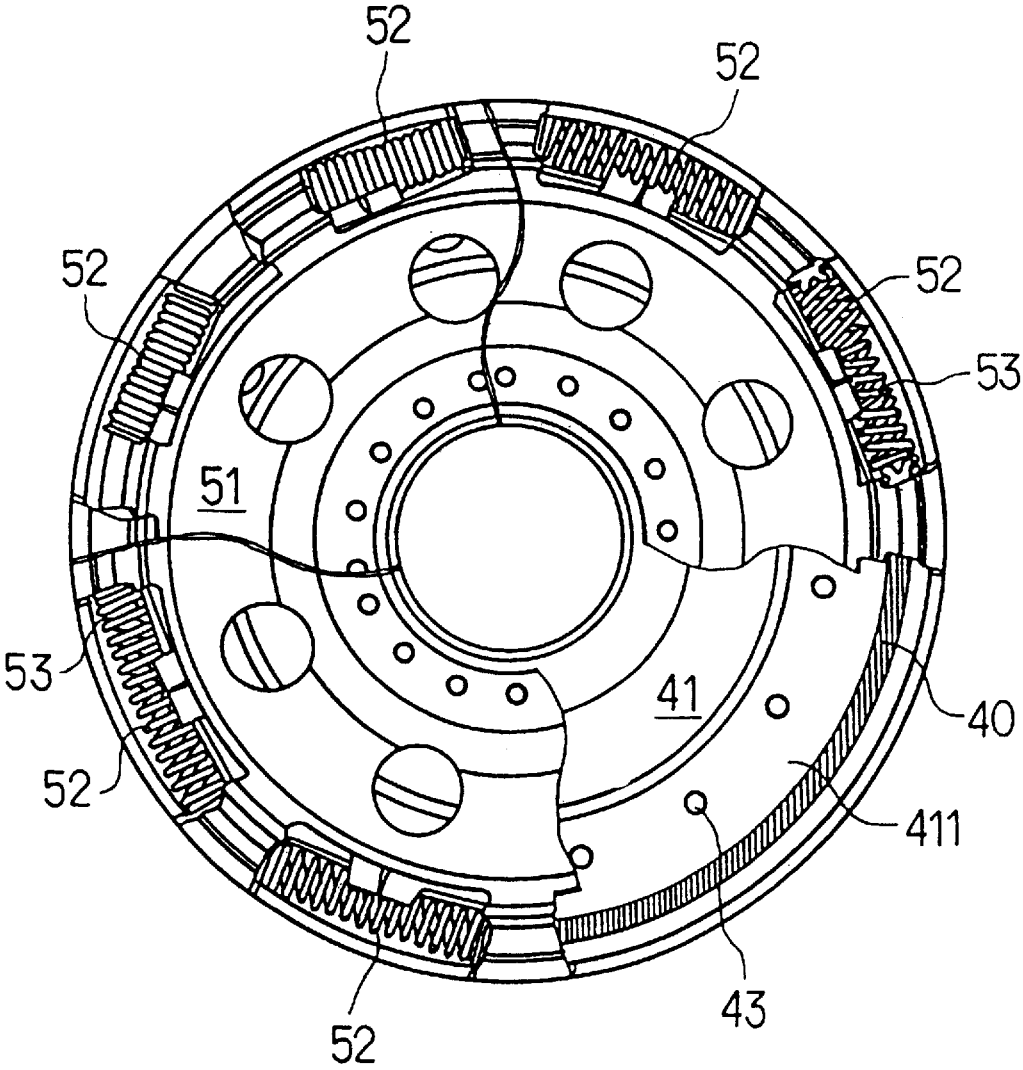
FIG. 7 is a plan view, partially enlarged, of a lock-up clutch piston to be treated in accordance with the present invention.

Application of the bainite forming process and apparatus, according to the first and second embodiments, to a lock-up clutch piston 41 for a torque converter, as shown in FIG. 7, will now be described. The lock-up clutch piston 41 is partially fixed by welding to a damper for absorbing the fluctuation of the torque transmitted in a torque converter. Reference numeral 43 in FIG. 7 denotes a hole for fixing the lock-up clutch piston. The damper device, as shown in FIG. 7, comprises a driven plate 51 integrally rotated with a turbine runner and springs 52 and 53. In this embodiment, as shown in FIG. 7, the springs 52 are designed for the first stage and are disposed at 8 positions around the circumference of the lock-up clutch piston 41, while the springs 53 are designed for the second stage and are disposed at four positions around the circumference of the lock-up clutch piston 41. The springs 53 are alternately provided in the springs 52. Furthermore, the diameter and longitudinal dimension of the springs 53 are smaller than those of the springs 52. Accordingly, the spring 53 starts to yield when the spiral angle of the spring 52 has reached a set value and the transmitted torque has reached a bending point.

Thus, the rotation transmitted from a front cover through a friction member is further transmitted to a turbine hub through the damper device. In this case, the springs 52 and 53 are compressed to absorb the fluctuation of the transmitted torque during the transmission of the rotation. These springs also play a role in absorbing vibration or noise produced when an abrupt change in the output torque of an engine is transmitted to the transmission (not shown).

When the lock-up clutch piston 41 is driven in the normal direction (when the lock-up clutch is engaged, the lock-up clutch piston 41 is caused to rotate counterclockwise in FIG. 7) and when it is driven in the reverse direction (when the lock-up clutch piston 41 is rotated clockwise in FIG. 7 to apply engine braking or the like), the springs 52 are compressed. Therefore, at this time, the springs 52 tend to slide on a flat portion 411 of the lock-up clutch piston 41. This gives rise to friction between the flat portion 411 of the lock-up clutch piston 41 and the spring 52 as a result of the sliding movement therebetween.

The lock-up clutch piston 41 is provided with a doughnut-shaped spring receiving portion 40 (as shown by hatching in FIG. 7) for contact with the spring 52.

Since the spring receiving portion 40 of the lock-up clutch piston is required to have enhanced abrasion resistance and strength, the spring receiving portion (about 3mm thick) must have bainitic structure in part (0.1–0.2mm thick).

The material used for the above member is S23C.

In implementing the bainite forming process, as described above in connection with the first and second embodiments, an electron beam is employed for the steps of heating and reheating the temperature. The above-described electron beam generating device is capable of producing an output of 5KW. With this electron beam device the feeding rate was 10m/min.

The above-described member is rotated at 25 rpm, and a portion thereof corresponding to a radius of 127mm is irradiated successively with the heating beam 11, an electron beam of 3.5KW, and with the reheating beam 12, an electron beam of 1.5KW (FIGS. 2 through 4).

The distance between the areas irradiated by the beams 11 and 12 is 20mm, and the deflection loci of both the beams 11 and 12 are 5mm in x-axis direction and 10mm in y-axis direction respectively. After the steel material 2 has been irradiated with the beam 11, it is cooled quickly by self cooling to the intermediate point temperature before being irradiated with the beam 12. In this case, the Vickers hardness of the surface of the steel material 2 is 450. According to the conventional method, this value is attained only by repeating the tempering process at 250° C. twice after the hardening process.

The bainitic structure is observed in the spring receiving portion of the above-described member, while the ferrite-pearlite structure remains in the other portions.

Figure 8:
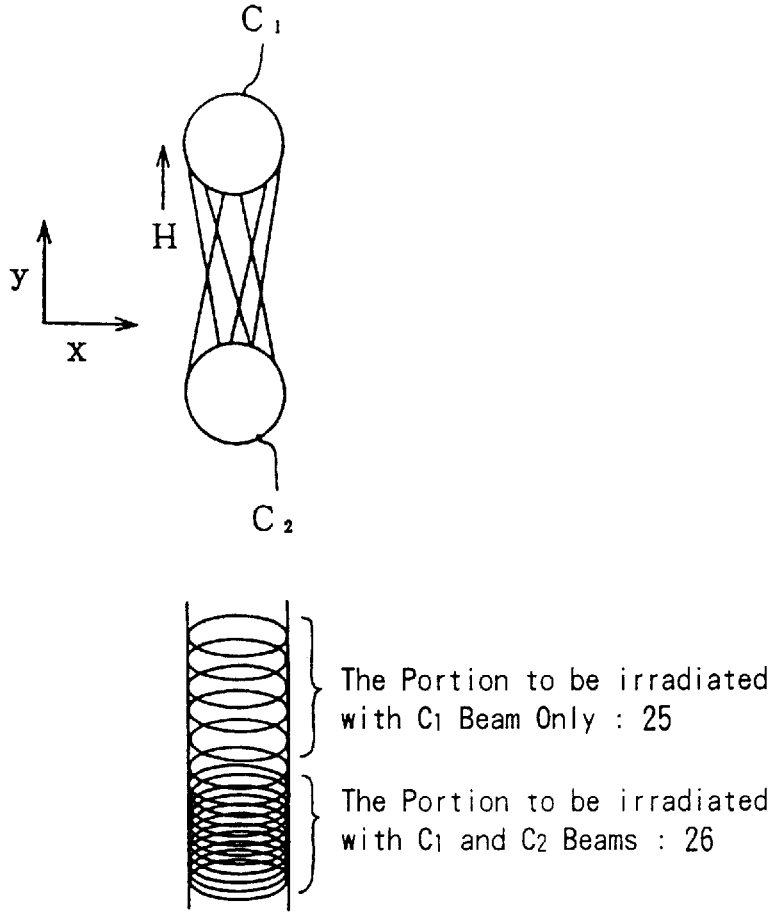
FIG. 8 is an explanatory diagram showing an example of the locus of the electron beam on an irradiated portion.

An example of the irradiation locus of an electron beam according to a sixth embodiment is shown in FIG. 8.

In this embodiment, the electron beam gives two circular deflection loci $C_1$ and $C_2$. The areas 25 and 26 which are thermally treated correspond, respectively, to the circular deflection loci $C_1$ and $C_2$. During the irradiation, the piece undergoing treatment is rotated about its central axis. Thus, the locus of the electron beam in each of the areas 25 and 26 undergoing thermal treatment is moved in the direction of arrow H.

Figure 9:
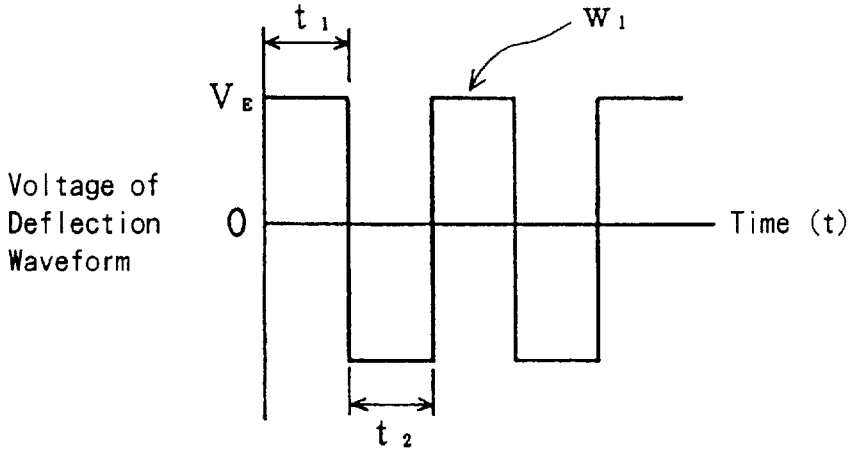
FIG. 9 is an explanatory diagram showing an example of a deflection waveform of the electron beam utilized as shown in FIG. 8.

Furthermore, each of the circular deflection loci $C_1$ and $C_2$ generates a sinusoidal deflection waveform in the directions of x-axis and y-axis and is formed by the combined deflections. Moreover, by changing each of the circular deflection loci $C_1$ and $C_2$ to alternately irradiate the treated areas 25 and 26, a deflection waveform w1 as shown in FIG. 9 is generated and superposed on the deflection waveform in the direction of y-axis. Thus, the area 25 is irradiated with the electron beam during the period t1 through which the voltage $V_E$ is positive, while the area 26 is irradiated with the electron beam during the period t2 though which the voltage $V_E$ is negative. Furthermore, with respect to the deflection waveform $w_1$, by setting the period t1 shorter and the period t2 longer, it is possible to adjust the energy of irradiation received by the areas 25 and 26.

Figure 10:
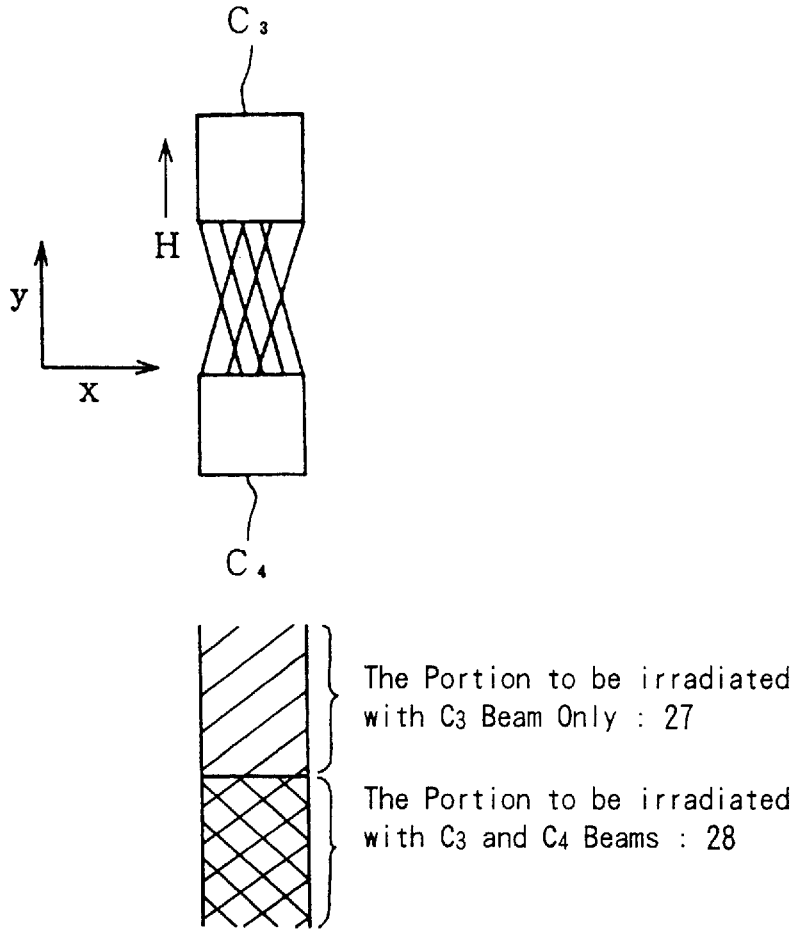
FIG. 10 is an explanatory diagram showing another example of locus of an electron beam on an irradiated portion according to an embodiment of the present invention.

FIG. 10 shows a seventh embodiment in which areas 27 and 28 are irradiated with the electron beam. In this seventh embodiment, the electron beam is emitted to provide two planar deflection loci $C_3$ and $C_4$. That is, the areas 27 and 28, respectively. During the irradiation, the piece under treatment is rotated about its central axis. Thus, in this embodiment also, the locus of the electron beam in the areas 27 and 28 is moved in the direction of arrow H.

Figure 11:
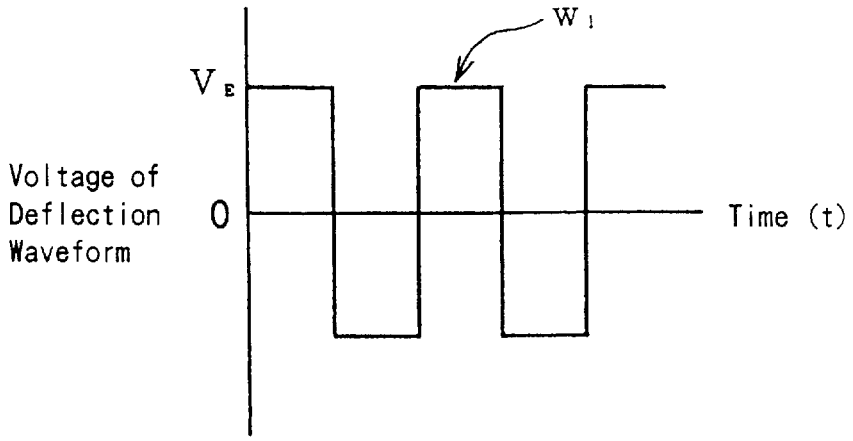
FIG. 11 is an explanatory diagram showing an example of the deflection waveform of the electron beam utilized as shown in FIG. 10.

Each of the planar deflection loci $C_3$ and C4 is formed by generating a deflection voltage having a triangular waveform in the directions of x-axis and y-axis. By changing the planar deflection loci $C_3$ and $C_4$ to irradiate the areas 27 and 28 with the electron beam, the deflection waveform $w_1$ as shown in FIG. 11 is superposed on the triangular waveform in the directions of x-axis and y-axis. It is also possible to combine the circular deflection with the plane deflection or to deflect the electron beam to provide it with a linear or elliptical locus.

In all other respects, this seventh embodiment is similar to the sixth embodiment.

Although the object described as treated in the above-described embodiment is a lock-up clutch piston for a torque converter, the present invention is applicable to any steel object having a surface in need of hardening, either entirely or partially, such as a sliding engagement surface of a multi-plate frictional engagement element, a connection portion where two members are connected to each other by means of a snap ring, etc, an oil pump plate, a seal ring, and the like.

Figure 12:
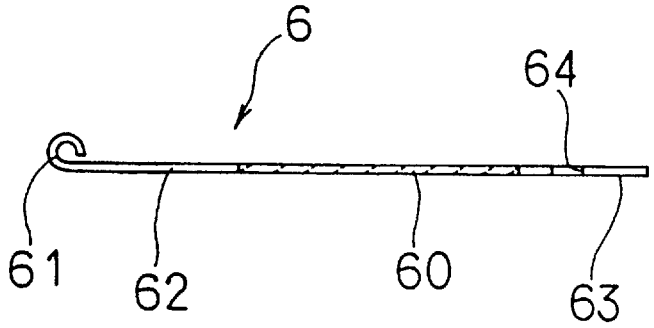
FIG. 12 is a side view of a detent spring which may be treated in accordance with the present invention.
Figure 13:
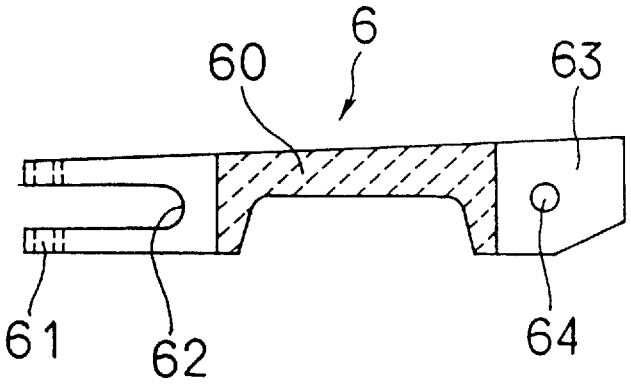
FIG. 13 is a plan view of the detent spring of FIG. 12.

An eighth embodiment, as shown in FIGS. 12 and 13, part of a detent spring 6 (of SK5 steel) is treated. The detent spring 6 is employed in a shifter of an automatic transmission and has a front end portion 61 for mounting a roller thereon, a concave portion 62 for accommodating a detent lever therein, and a fixed portion 63. The fixed portion 63 is provided with a mounting hole 64. The portion 60 (indicated by an alternate long and short dash line) represents the area to be treated by the bainite forming process according to the present invention. As in the previous embodiments two different electron beams are used. In all other respects, this embodiment is similar to the second embodiment.

Conventionally, in contradistinction, the entire detent spring is subjected to hardening and tempering.

Figure 14:
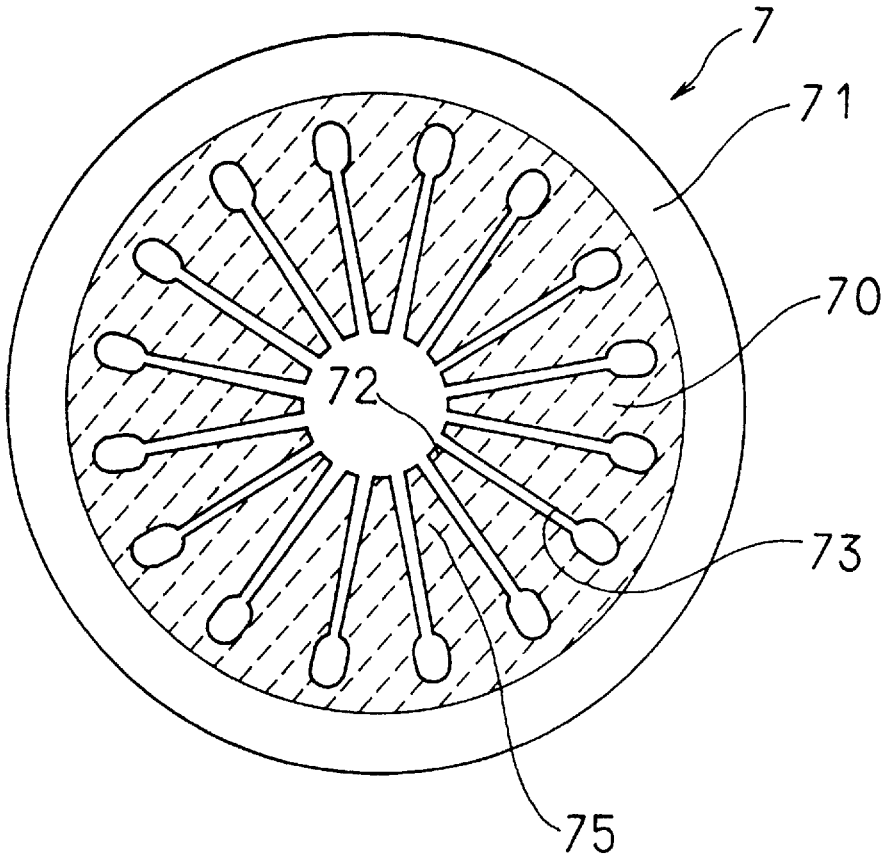
FIG. 14 is a plan view of a diaphragm spring which may be treated in accordance with the present invention.
Figure 15:
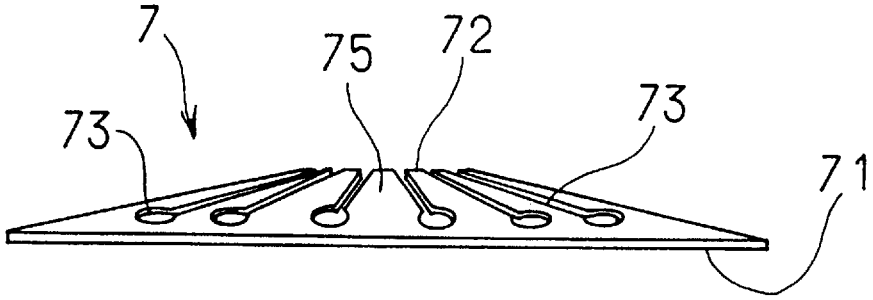
FIG. 15 is a side view of the diaphragm spring of FIG. 14.

In a ninth embodiment, a diaphragm spring 7, as shown in FIGS. 14 and 15, is treated in part. The diaphragm spring 7 is S50C steel and is employed in a clutch disk of an automobile, and has a conical base portion 71 and a radial spring portion 75 which is radially divided by holes 73 and which radially extends from central front end portions 72. The portion 70 (indicated by alternate long and short dash lines), including the aforementioned spring portion 75, is treated by the bainite forming process according to the present invention.

In all other respects, this embodiment is similar to the eighth embodiment.

Conventionally, in contradistinction, the entire diaphragm spring 7 is treated by the austempering process.

The temperature-raising bainite treating process according to the present invention reduces the time required for a complete thermal treatment as well as the cycle time for the thermal treatment device without requiring any special means for handling the steel material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A process for treating a steel object to form a bainite structure therein, comprising:

heating the steel object to a first temperature higher than an austenitic transformation point temperature;

quenching the steel object to an intermediate point temperature higher than a martensitic transformation point temperature during a quenching interval starting with discontinuation of said heating;

reheating the steel object from the intermediate point temperature to a second temperature in a range of bainitic transformation to form the bainitic structure, said quenching interval ending with initiation of said reheating and without the temperature of the steel object going below said intermediate point temperature;

discontinuing said reheating before the austenitic transformation point temperature is reached; and cooling the steel object.

2. A process according to claim 1, wherein said reheating heats the steel object through said range corresponding to bainitic transformation, from a bainitic transformation starting point to a bainitic transformation ending point.

3. A process according to claim 2, wherein in both of said heating and said reheating only a portion of the steel object is heated by localized irradiation with a high-density energy beam.

4. A process according to claim 1, wherein in both of said heating and said reheating only a portion of the steel object is heated by localized irradiation with a high-density energy beam.

5. A process according to claim 3, wherein said reheating raises the temperature of the steel object in a plurality of steps.

6. A process according to claim 4, wherein said reheating raises the temperature of the steel object in a plurality of steps.

7. A process according to claim 3 wherein said heating is with a first high-density energy beam and said reheating is with a second high-density energy beam separate from said first high-density energy beam and wherein said steel object portion is moved through said first and second beams in succession with said quenching initiated upon exiting said first beam and terminated upon entering said second beam.

8. A process according to claim 4 wherein said heating is with a first high-density energy beam and said reheating is with a second high-density energy beam separate from said first high-density energy beam and wherein said steel object portion is moved through said first and second beams in succession with said quenching initiated upon exiting said first beam and terminated upon entering said second beam.

9. A process according to claim 7 wherein the movement of the steel object portion through said first and second beams is continuous and at a constant speed.

10. A process according to claim 8 wherein the movement of the steel object portion through said first and second beams is continuous and at a constant speed.

11. A process according to claim 3 wherein said high-density energy beam is emitted from a single beam generating source and divided to irradiate a plurality of portions of the steel object.

12. A process according to claim 4 wherein said high-density energy beam is emitted from a single beam generating source and divided to irradiate a plurality of portions of the steel object.

13. A process according to claim 3 wherein a surface layer of the steel object portion is melted when heated to said first temperature.

14. A process according to claim 4 wherein a surface layer of the steel object portion is melted when heated to said first temperature.

15. A process according to claim 1 wherein said quenching is executed at the rate of $10^3$ °C./min. or more.

16. A process according to claim 1 wherein said bainite transformation range is an S curve having a nose portion and wherein said intermediate point temperature is lower than a temperature corresponding to the nose portion of the S curve.

17. A process according to claim 1 wherein said bainitic structure is at least one structure selected from the group comprising of upper bainite, lower bainite, and sorbite structures.

18. A process according to claim 1 wherein said cooling is continuous from said second temperature to room temperature.

19. A process according to claim 7 wherein the movement of the steel object portion is by rotation of the steel object.

20. A process according to claim 7 wherein said second beam is less than one-half the power of said first beam.

* * * * *